US010745197B2

(12) United States Patent
Peek et al.

(10) Patent No.: US 10,745,197 B2
(45) Date of Patent: Aug. 18, 2020

(54) MULTI-USE GARBAGE TRUCK

(71) Applicant: The Heil Co., Chattanooga, TN (US)

(72) Inventors: Shane Peek, Pisgah, AL (US); Richard Ford, Fort Payne, AL (US); Chad Gentry, Fort Payne, AL (US); John Smith, Flat Rock, AL (US); Bobby McKinney, Fort Payne, AL (US); John Bedwell, Southside, AL (US); Brian Parker, Fort Payne, AL (US); Ken Beaver, Fort Payne, AL (US)

(73) Assignee: The Heil Co., Chattanooga, TN (US)

( * ) Notice: Subject to any disclaimer, the term of this patent is extended or adjusted under 35 U.S.C. 154(b) by 0 days.

(21) Appl. No.: 16/272,575

(22) Filed: Feb. 11, 2019

(65) Prior Publication Data

US 2019/0308811 A1 Oct. 10, 2019

Related U.S. Application Data

(63) Continuation of application No. 14/809,616, filed on Jul. 27, 2015, now Pat. No. 10,239,689.

(51) Int. Cl.
*B65F 3/04* (2006.01)
*A47L 11/00* (2006.01)
(Continued)

(52) U.S. Cl.
CPC ..... *B65F 3/041* (2013.01); *A47L 11/00* (2013.01); *B65F 3/06* (2013.01); *B65F 3/14* (2013.01);
(Continued)

(58) Field of Classification Search
CPC ..... B65F 3/041; B65F 2003/0253; B60P 1/50
See application file for complete search history.

(56) References Cited

U.S. PATENT DOCUMENTS 3,878,956 A * 4/1975 Van Der Lely ..... B60P 1/16 414/487
4,119,225 A 10/1978 Macht
(Continued)

FOREIGN PATENT DOCUMENTS

DE 4406806 9/1995
DE 102009046213 5/2011
(Continued)

OTHER PUBLICATIONS

Henkel, Gerald: EP 0860380 A1 (Aug. 26, 1998) English language machine translation. Retrieved Nov. 4, 2019 from espacenet.com. (Year: 1998).*
(Continued)

*Primary Examiner* — Jonathan Snelting
(74) *Attorney, Agent, or Firm* — Fish & Richardson P.C.

(57) ABSTRACT

A multi-use garbage truck has an ability to not only to front load containers of garbage into a hopper in a refuse collection body, but also an ability to swap out the forks, if not arm connection assemblies, or even entire frame arms, to be replaced with one of a plurality of attachments which connect to at least one, if not both frame arms with attachments for various uses such as snow plow, leaf blower, street sweeper, bucket, grapple, etc. Furthermore, an ability to independently operate the left frame arm relative to the right frame arm can now be provided so that the left frame arm can utilize and perform one function and the right frame arm provide another or at least be independently operable from one another.

21 Claims, 8 Drawing Sheets

(51) Int. Cl.

| | |
|---|---|
| ***B65F 3/06*** | (2006.01) |
| ***B65F 3/14*** | (2006.01) |
| ***E01H 6/00*** | (2006.01) |
| ***E01H 1/02*** | (2006.01) |
| ***E01H 1/08*** | (2006.01) |
| ***E01H 5/06*** | (2006.01) |
| ***E02F 3/34*** | (2006.01) |
| ***E02F 3/413*** | (2006.01) |
| *B65F 3/02* | (2006.01) |

(52) U.S. Cl.

CPC ..... *E01H 1/02* (2013.01); *E01H 1/0809* (2013.01); *E01H 5/061* (2013.01); *E01H 6/00* (2013.01); *E02F 3/34* (2013.01); *E02F 3/413* (2013.01); *B65F 2003/0223* (2013.01); *B65F 2003/0253* (2013.01); *B65F 2003/0279* (2013.01)

(56) References Cited

U.S. PATENT DOCUMENTS

| | | | |
|---|---|---|---|
| 4,305,693 | A | 12/1981 | Naab |
| 5,033,930 | A | 7/1991 | Kraus |
| 5,098,252 | A | 3/1992 | Sheesley et al. |
| 5,107,610 | A | 4/1992 | Fusco |
| 5,145,305 | A | 9/1992 | Green |
| 5,344,272 | A | 9/1994 | Nuyts |
| 5,607,277 | A | 3/1997 | Zopf |
| 5,639,201 | A | 6/1997 | Curotlo |
| 5,727,342 | A | 3/1998 | Horton |
| 5,769,596 | A | 6/1998 | Burton |
| 5,772,385 | A | 6/1998 | Huntoon |
| 6,224,317 | B1 | 5/2001 | Kann |
| 6,375,405 | B1 | 4/2002 | Kallevig |
| 6,699,311 | B2 | 3/2004 | Smith et al. |
| 6,846,148 | B2 | 1/2005 | Riba Romeva |
| 6,907,941 | B1 | 6/2005 | Hoffart |
| 7,014,385 | B2 | 3/2006 | Lim |
| 7,210,890 | B2 | 5/2007 | Curotto |
| 7,871,233 | B2 | 1/2011 | Arrez |
| 9,028,193 | B2 | 5/2015 | Goedken |
| 9,272,843 | B2 | 3/2016 | Parker |
| 9,296,558 | B2 | 3/2016 | Parker |
| 9,434,540 | B2 | 9/2016 | Goedken |
| 9,624,641 | B2 | 4/2017 | Martin |
| 10,035,648 | B2 | 7/2018 | Haddick et al. |
| 10,239,689 | B2 | 3/2019 | Peek et al. |
| 2006/0210384 | A1 | 9/2006 | Warren |
| 2013/0322994 | A1 | 12/2013 | Curotto et al. |
| 2015/0298905 | A1 | 10/2015 | Cooper |
| 2018/0334324 | A1 | 11/2018 | Haddick et al. |

FOREIGN PATENT DOCUMENTS

| | | |
|---|---|---|
| EP | 0860380 | 8/1998 |
| EP | 1947249 | 7/2008 |
| ES | 2442866 | 2/2014 |
| WO | WO2017210325 | 12/2017 |

OTHER PUBLICATIONS

European Search Report in European Application No. EP16181388, dated Feb. 1, 2017.

* cited by examiner

PRIOR ART

MULTI-USE GARBAGE TRUCK

CROSS-REFERENCE TO RELATED APPLICATIONS

This application is a continuation of, and claims priority under 35 U.S.C. § 120 to, U.S. patent application Ser. No. 14/809,616, filed Jul. 27, 2015 and entitled "Multi-Use Garbage Truck." The entire contents of this prior application is hereby incorporated by reference in its entirety.

FIELD OF THE INVENTION

The present invention relates to front loading garbage vehicles and more particularly to a front loading garbage truck having a capability to accept at least one other attachment instead of forks normally utilized to pick up dumpsters or even semi-permanent automated dumpsters.

BACKGROUND OF THE INVENTION

The applicant has been manufacturing front loading garbage trucks for many years. The Half/Pack® line of vehicles has been very successful. Front-loading waste-collecting and hauling vehicles are ubiquitous in the commercial and residential refuse collection industry. Typically, when front-loading is employed, a heavy-duty truck or a like, steerable vehicle is provided with a pair of hydraulically-actuated front forks situated to extend in front of the vehicle. The forks can be raised, lowered and tilted in front of the driver's cab so that an operator can see the forks, guide the forks into lifting engagement with a front-loadable refuse container and lift the container with the forks.

Conventionally, fork-accepting pockets are provided at the sides of fork-liftable refuse containers. The pockets may be made entirely of metal and may be welded to the metallic sidewalls of a standard-width refuse collecting bin or they may be formed as integral extensions of the metallic bottom floor of the collecting bin. A standard-width refuse collecting bin may be one having a width of approximately 81 inches if it is a so-called, 2 yard to 6 yard refuse bin as used in the USA. Bin widths and/or fork spacing distances may vary somewhat in different locations.

During a waste collection operation which takes place under the fork lift approach, the fork-liftable bin is often placed and oriented so that a collections vehicle can be easily drive forward towards a back wall of the bin and insert its forks into fork-receiving pockets of the bin, under driver supervision. The fork insertion operation may include the step of pre-aligning the forks so they can extend forward clear of the back wall and the step of tilting the forks so that they will enter fork-receiving openings of the pockets as the vehicle drives forward. The vehicle driver and/or an additional fork operator is/are responsible for angling, altering the height of, or otherwise aligning the forks with the pocket openings as the collections vehicle drives forward so that the forks will properly engage with the pockets. After the forks are fully inserted into the pockets, the cab driver and/or the assisting operator can initiate a motorized (e.g., hydraulic) operation which will untilt and/or lift the inserted forks and thereby raise the refuse bin off the ground for transporting it or emptying its contents. Often the contents of the fork-lifted bin are emptied into a rear-mounted hopper that sits behind the driver's cab. An over-the-top translating action is often used to position the lifted bin over the truck's back hopper and to dump the container's refuse into the back hopper.

The front-loading lift and/or dump-over-the top operation is typically performed under manual-control. Controllers such as air-powered hydraulic actuators or other such motor controls are typically provided inside the drivers cab so that an in-cab operator (the driver or another person) can manipulate them in order to activate hydraulic pistons or other motor means in a desired sequence so as to move the forks simultaneously and the fork-supported refuse bin and so as to bring the bin and forks into manually-determined positions.

FIGS. 1A and 1B show a prior art refuse body as would be mounted on a vehicle as would be understood by those of ordinary skill in the art. The forks 2,3 may connect to a container such as a semi-automated collection container (U.S. Pat. No. 5,639,201 incorporated herein by reference) sold by the sister company of the applicant whereby this device has a side loading feature that can side load residential cans into the container 4 in front of the cab of the vehicle with a loading grasper 5 partially obscured by view. See FIGS. 2A and 2B as well. Upon loading the container 4 to a sufficient degree with the grasper 5, the container 4 can be rotated with the frame arms 12,13 about pivots 6,7 simultaneously with the container 4 then directed over the cab protector 8 and into the receiver 9 of the body 1 for hauling from one location to another as would be understood by those of ordinary skill in the art. This successful design improvement for robotic assistance is seen in U.S. Pat. No. 5,639,201 which issued in 1997 to John D. Curotto.

The major part of an extendible robotic arm mechanism can be mounted to a front sidewall of an intermediate container. Only a small and flattened-when-retracted, cart-grasping part of the robotic arm fits along the curb-side of the refuse container. Thus the negative impact on the width-wise volume of the container is minimal. Remote controls are provided in the vehicle cab for allowing the driver to automatically and hydraulically extend the robotic arm out from along the front wall of the intermediate container, this causing the arm to extend outwardly (to the right in the USA) to reach a curb-side waste item. Further remote controls are provided for causing the flattened-when-retracted, grasping part of the robotic arm to automatically wrap itself around the waste basket or other refuse item. Another remote actuator automatically causes the robotic arm to rotate about a pivot point such that the arm lifts the waste item and rotationally translates it to a position over an open top of the low-profile, intermediate container. The grasping action of the robotic arm may then be undone so as to dump the waste item into the intermediate container. Alternatively, if an open-top or swivel-top waste basket is used, its contents will naturally empty into the intermediate container as the arm's rotational translation proceeds past a 90 degree rotation point. The robotic arm is then rotated back in the other direction, and if a residential waste container is still grasped, the grasping action of the robotic arm may then be undone so as to return the waste basket to a position near its point of origin.

In one embodiment, the intermediate container is a so called, 4-yard bin having a height dimension of about 66 inches and a length of about 56 inches. The robotic arm has a sliding plate mechanism which allows its grasping portion to reach out to the curb a distance of about 60 inches from the right sidewall of the bin and to retract a grasped load about the same distance back toward the bin (the intermediate container). These slide out, grasp, and rotate mechanisms are made sufficiently strong to allow the robotic arm to grab waste baskets having residential refuse volumes in the range of 32-106 gallons. Total cycle time from reach out, to grab, rotate, empty, and return can be as little as about 4 seconds. (Cycle time may vary as a function of reach out distance and other parameters.) The relatively low height of the 4-yard bin allows the truck driver to easily look out his front window and see what is being dumped from the rotated waste basket into the bin while the driver sits reposed in the truck's cab, operating the remote actuators of the robot's slide-out extender, grasper and rotator mechanisms. A screen-like windguard at the front of the bin allows the driver to look forward ahead of the bin while keeping in-bin refuse from being easily blown out by air flow. The driver does not need to step out of the vehicle during the collections operation unless he or she spots unacceptable materials being dropped in, in which case he/she may have to manually separate away such unacceptable material. The relatively low height of the 4-yard bin also helps to reduce the amount of energy consumed by the vehicle with each grab, rotate and dump cycle. The low height of the 4-yard bin further helps to reduce the amount of noise made by the vehicle, as the robot arm successively reaches out, grasps, rotates, dumps and returns one curb-side basket after the next while the vehicle drives down a residential street. The volume of the intermediate container is not substantially consumed in the width-wise direction by the front-mounted robotic arm mechanism because a bulk part of the robotic mechanism sits on the front side of the container (4-yard bin). When the full volume of the standard-sized intermediate container is filled, a frontal lift-and-dump-over-the-top may be carried out to make room for additional refuse. FIG. 1B shows the typical dumping of prior art containers 4 with the frame arms 12,13.

While the container 4 of U.S. Pat. No. 5,639,201 can be removed from forks similar to forks 2 and 3, with the disengagement of an electrical connection running along cross bar 10, the frame arms 2 and 3 might be able to pick up a traditional container in a similar manner as the container 4 is picked up and dumped. However, other than picking up and dumping containers 4 into receiver 9, there is little other versatility for the vehicle 1. Furthermore, the forks 2 and 3 must always be lifted simultaneously together with the frame arms 12 and 13 rotating together. Although frame arms 12,13 are connected to separate cylinders 14,15, the cylinders 14,15 are traditionally simultaneously operated together to rotate the frame arms 12,13 simultaneously.

In today's environment, municipalities and others may have a need to multi task vehicles for various uses. Specifically, after a snow storm, garbage trucks may not be able to be deployed until the streets are cleared. Furthermore, or alternatively, a municipality may have only a limited number of snow plows on hand. Accordingly, a garbage vehicle may be left in a waiting status until the streets are cleared sufficiently enough for use. Furthermore, although a single container can be lifted simultaneously the forks 2,3 such as the container 4. Other options may be desirable for an improved system to be available as an option to municipalities or other customers for various uses.

SUMMARY OF THE INVENTION

Accordingly, it is a present object of many embodiments of the present invention to provide a refuse vehicle having opposing frame arms which may selectively connect to at least one other attachment other than fork arms for use with a refuse container such as the semi-automated can of U.S. Pat. No. 5,639,201 or a traditional refuse container for use with front loading vehicles such as a 6 or 9 yard container, etc., as are well known in the art. Such uses may include but are not limited to, a snow plow attachment, a bucket attachment, a salt spreader attachment, a grapple attachment, a curb sweeping attachment, a leaf blowing attachment, and/or other attachments as may be deemed desirable other than can lifting forks.

It is another use in many embodiments of the present invention to provide a refuse vehicle having a mode for independently operating frame arms so that one frame arm could be rotated about a pivot axis to dump a container or for other use, while the opposing frame arm may be performing a similar or dissimilar function independently of the rotation of the other frame arm.

It is another object of many embodiments of the present invention to provide a refuse vehicle and body having at least one of a compatibility for attachments other than forks for lifting a container such as, but are not limited to, a snow plow attachment, a bucket attachment, a salt spreader attachment, a grapple attachment, a curb sweeping attachment, a leaf blowing attachment, etc.

Furthermore, it is an object of at least some embodiments of the present invention to configure one of the arms to be connectable to a residential refuse container grasping mechanism such as are well known in the art particularly for side loading refuse vehicles while the other arm may be similarly utilized with a separate grapple and/or another attachment such as an arm for holding a refuse container which might be manually loaded by personnel in front of the driver where the driver could possibly more easily and safely see the operation of the workers in his vicinity or other items of interest. By placing work in front of the driver, the driver has the potential to have a better view of the activity in and around the vehicle. The frame arms could be independently rotatable to dump in the refuse bin behind the cab in such a configuration.

Additionally, it is an object of many embodiments to provide an ability to relatively easily switch out container lifting forks whether they are forks configured for the can of U.S. Pat. No. 5,639,201 or standard forks for commercial containers for at least one other attachment such as a sweeper attachment, a leaf blowing attachment, a grapple attachment, a bucket attachment, a snow plow attachment, etc. Other portions of the refuse vehicle could be utilized with some attachments such as a bucket which might actually be able to lift material up over the cab and deposit it within the bin in the body of the refuse vehicle such as if lifting mulch, snow or other materials into the body. The snow plow or bucket might be used to remove snow from a particular location in addition to pushing snow with a blade of the attachment, etc.

Accordingly, there are a number of presently preferred embodiments of the present invention disclosed herein. Specifically, a first presently preferred embodiment of the present invention provides an ability to relatively quickly change implements on the front of a front end loader refuse vehicle having opposing arms which extend typically from behind the cab of a chassis and then in an upwardly and then often over the cab and then downwardly in front of the cab in a somewhat of a "n" shape whereby the front part of those frame arms can be relatively easily attached to container forks along a rotating cross bar as is traditionally done by various manufacturers. Unlike traditional front end loading garbage trucks, the presently preferred embodiment provides an ability to swap out the frame forks and possibly even the cross bar to accommodate attachments such as a snow plow, leaf blower, street sweeper, salt spreader, snow plow, bucket, etc., so that the garbage truck can now be a multi-use vehicle rather than just a garbage truck that performs essentially a single function (i.e., dumping containers into a refuse collection body). Although two embodiments connection systems are shown for connecting the frame arms to the various attachments, there are certainly other connection systems which could be utilized for various embodiments, some of which may have hydraulic and/or electric connections (i.e., quick connects) which may preferably be constructed to be relatively easily changed out for the various attachments, some of which may require the use of either or both of hydraulics and/or electricity. Other attachments may not utilize either of hydraulics or electricity.

Furthermore, the mechanical connection of the frame arms to the attachments are also preferably made in a way so that operators may relatively easily change out the to most likely be for a limited time and then switched back to traditional garbage collection configuration with forks possibly in connection with combination with the container of U.S. Pat. No. 5,639,201 showing a semi-automated side loading container.

Another embodiment of the present invention provides an ability to separately rotate the left and right frame arms independently of the other in a first operational configuration which differs from the garbage collection configuration. No other manufacturer is known to have provided such a feature for a front loading refuse vehicle. Such embodiments also preferably have the ability to couple the movement together in the garbage collection configuration either through software and/or hardware so that they can operate in a traditional manner. For at least some embodiments, moving independently of one another such as if a residential can grabber were attached to one frame arm and a manual load container were connected on the other frame arm so that operators may have the option of operating one of the arms independently of the other (in the first operational mode with configuration) such as for various improvements as could be envisioned. An ability to load recyclables on one side of the bin while also simultaneously dividing the refuse body behind the chassis so that different materials may possibly be sorted behind the driver or not depending could occur dependently upon the particular application.

For at least some embodiments the cross bar member between the frame arm may be removable with the change out of each of the various attachment assemblies. For other embodiments, it may be possible to retain the cross bar in place and connect the attachments such as the forks thereto such as in a rapidly deployable manner or not. Other embodiments may provide for a portion of the frame arms themselves to connect either directly or indirectly to specific attachments so that each attachment may provide its own cross bar or not (particularly if each of the arms would be independently operable relative to the other). Meanwhile, it relatively quick connect electrical and hydraulic and/or hydraulic fittings as may be useful for operating various attachments. Quick connect electrical and hydraulic connections are typically the class of connections which do not require tools, such as press and twist and/or other couplings as would be understood by those of ordinary skill in the art. Furthermore, when replacing a portion of the frame arms, it is also possible that the traditional cylinder attachment for rotating the forks may need to be connected in a slightly different manner as has been done in the prior art but could facilitate the ability to continue to use the hydraulic cylinder used to rotate forks for the picking up of containers and/or dumping of the container in the refuse body. These cylinders may or may not connect to the various attachments in other ways or possibly not be employed (or even removed entirely) for the use of a particular implement or attachment which may not have a need to rotate a cross bar to a portion of the frame arms depending on the particular use.

For some attachments, it may be desirable to provide different operational limitations to keep from operating the pistons of the cylinders in the specific attachment than when using forks. It also may be that the electronic and hydraulic controls are connected through a system so that the vehicle may coordinate with software to understand which implement is utilized so that a particular set of operating capabilities and/or limitations are imposed such as preventing the operation of the cylinder if it does not have any particular use for a particular attachment or directing the path of attachments connected to it so as to prevent the attachment from coming into contact with either the chassis or the refuse body at undesired locations. Still other embodiments may include any of the above advantages and/or others as would be obvious to those of ordinary skill in the art through the disclosure herewith.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENTS

Figure 1A:
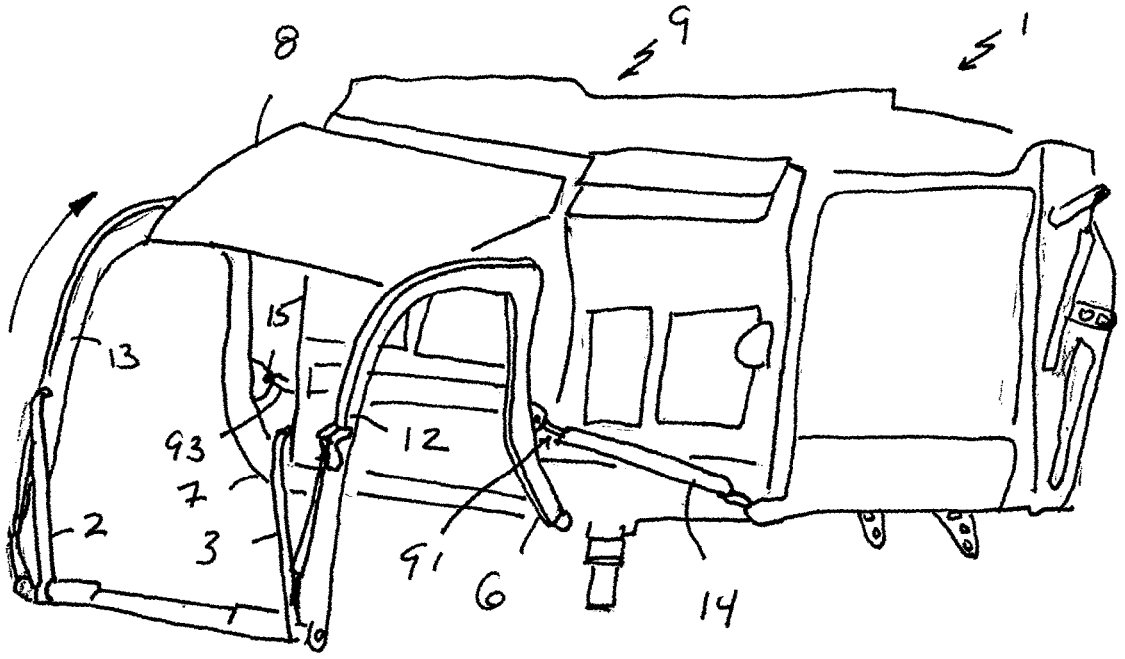
FIG. 1A is a front perspective view of a prior art refuse body.
Figure 2A:
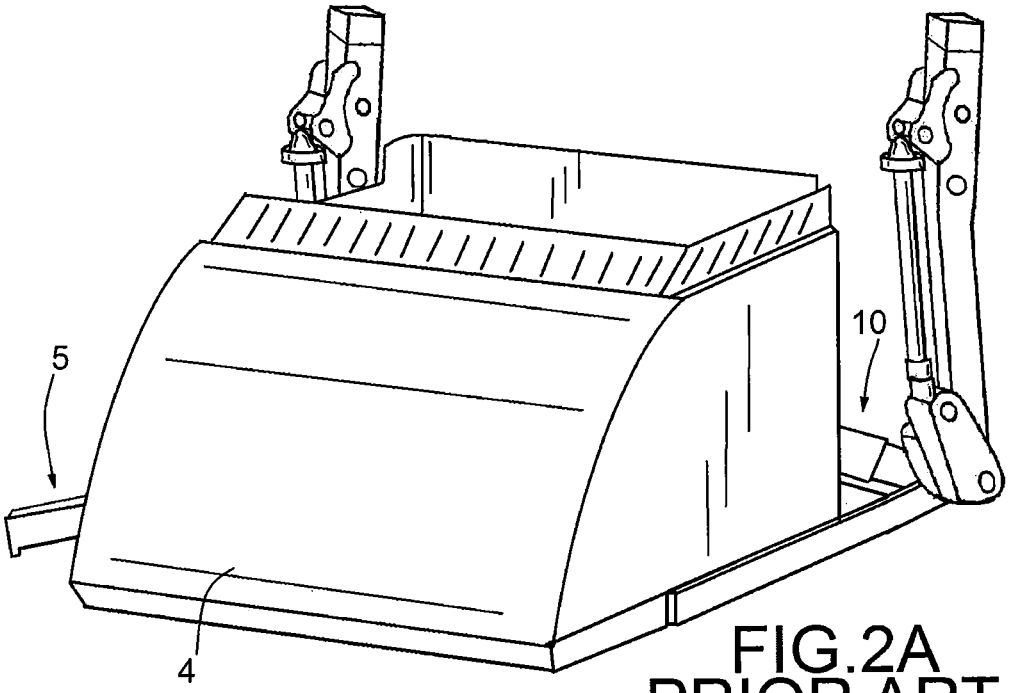
FIG.2A PRIOR ART
FIG. 2A is a right side perspective view of a prior art semi-automated can connected to forks.
Figure 2B:
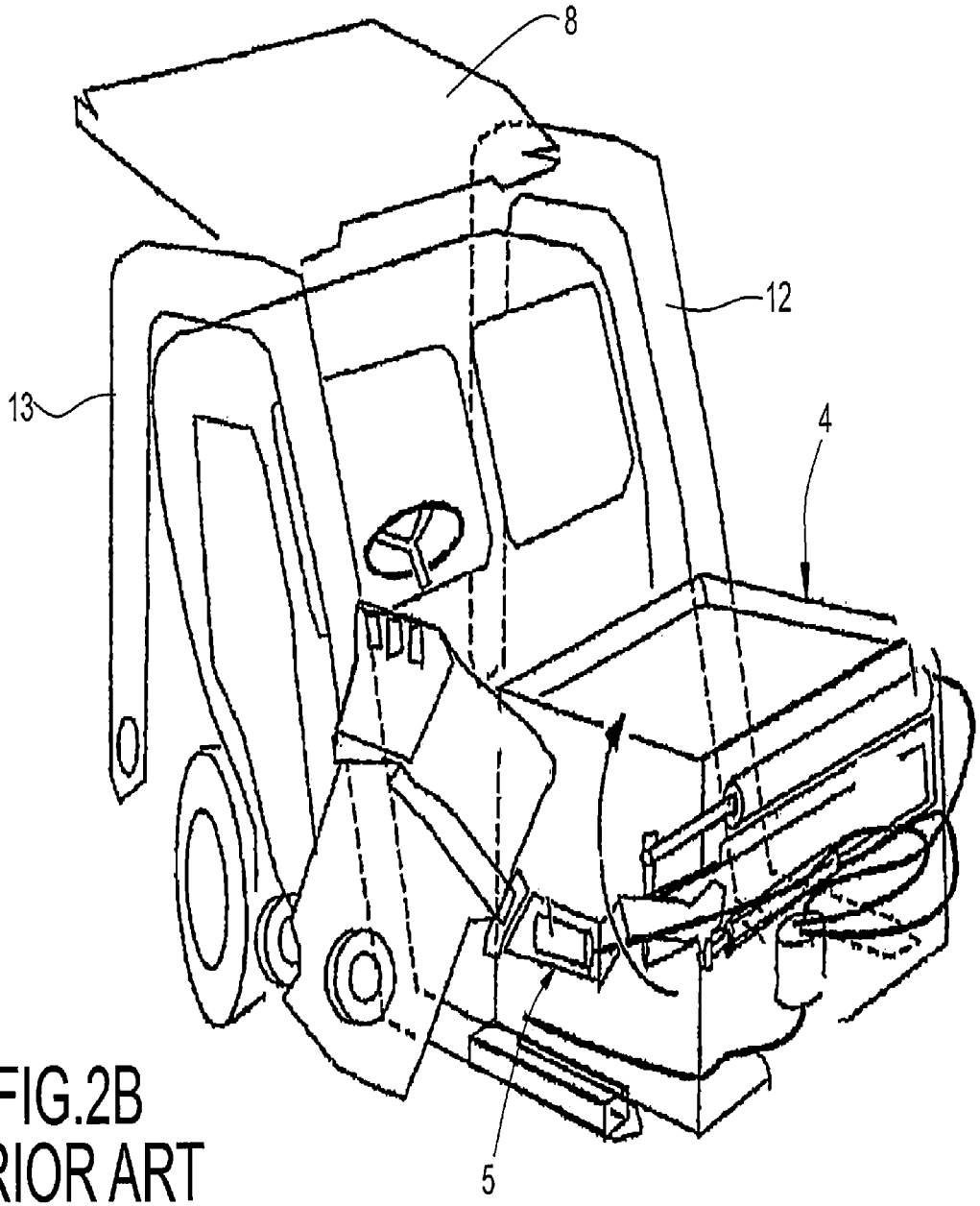
FIG.2B PRIOR ART
FIG. 2B is a left side perspective view of the prior art semi-automated can connected to forks.

FIG. 1A showed a prior art construction with standard forks of a garbage truck body 1 having right and left forks 2,3 for holding a garbage receptacle such as a 3 yard, 6 yard, 9 yard, etc., container and then dumping into the receiver 9 as would be understood by those of ordinary skill in the art. This body 1 is mounted to a chassis 16 having a cab 17 as are provided by various manufacturers as would be understood by those of ordinary skill in the art. Although standard commercial containers can be dumped using this construction, a number of years ago one of the applicant's divisions developed the structure of FIGS. 2A and 2B where a container was semi-permanently connected to the forks 2,3 which used a grasper 5 to grab residential cans and dump them into the container 4 and then after filling to a sufficient degree, dump the container 4 into the receiver 9. This device was an excellent innovation and is widely used across America today. However, other than selecting the use of the container 4 or picking up other commercial receptacle containers as are well known in the art, there are typically no other uses for the garbage truck body 1. With increasing pressures on municipalities and other departments, it would be desirable to have an ability to replace the forks 2,3 with other attachments in order to provide other functions other than just the filling of containers such as container 4 and/or dumping containers 4 into the receiver 9.

Figure 3:
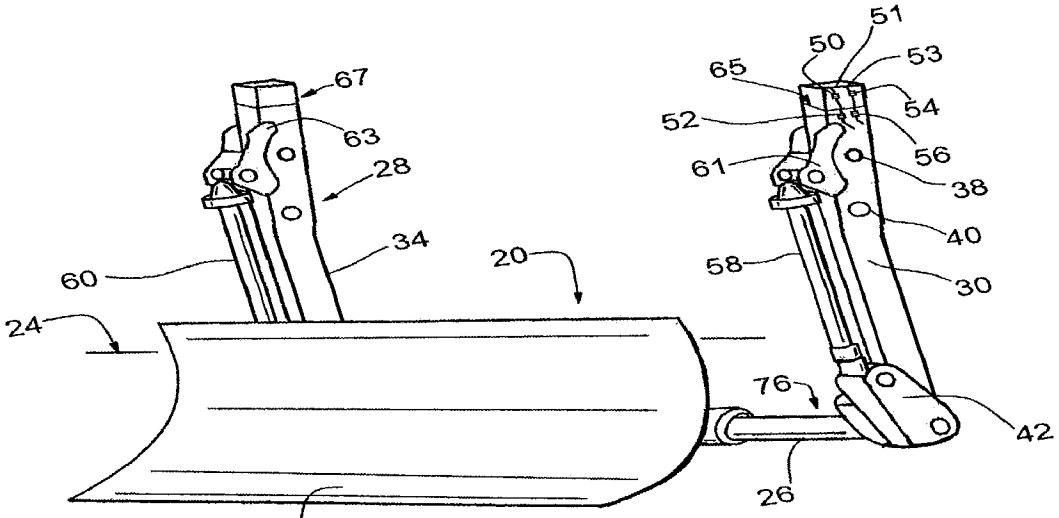
FIG. 3 is a front perspective view of a presently preferred embodiment of a first attachment.
Figure 7:
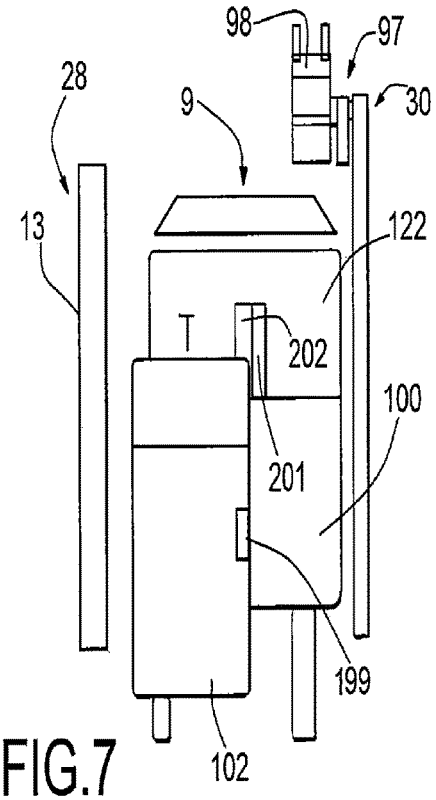
FIG. 7 is a front plan view of a vehicle with a refuse body with the left and right frame arms independently rotatable relative to one another for independent movement showing one can dumping and the other holding a second attachment in the form of a container in the first configuration.

For instance, FIG. 3 shows a first attachment 20 in the form of a snow plow and/or other blade 22 which may be disposed along an axis 24 which may be parallel to a cross bar 26 extending between frame arms 28,30 or not. In fact, the axis 24 may be angled relative to the cross bar 26 for some applications to assist in deflecting snow to one side or the other of an attached vehicle such as vehicle 100 as seen in FIG. 7 and as could be connected to the body 1 of FIG. 1 as would be understood by those of ordinary skill in the art.

Figure 4:
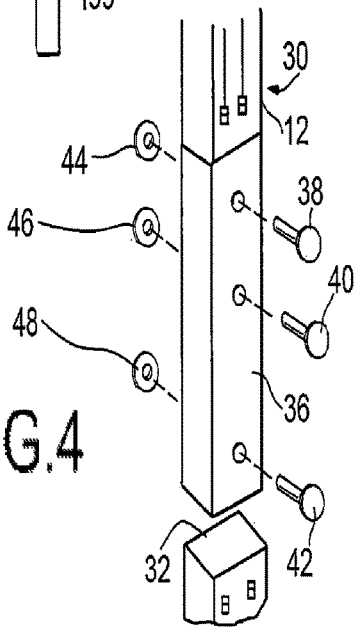
FIG. 4 is an exploded view showing the construction of the arms of FIG. 3.

The snow plow attachment 20 could be attached in a number of ways to the frame arms 12 and 13 of the container body 1. The one preferred way of attaching them is shown in FIG. 4. Specifically, at a lower end of the frame arms 12,13, a modification of frame arms 28,30 is made relative to prior art constructions. Specifically, the frame arms 28,30 connect to arm connectors shown as sleeves 32,34. Specifically, extension 36 is shown being received within sleeve 32 with one or more connectors such as connectors 38,40,42 being directed through the sleeve 32 and the extension 36 and out the opposite side of the sleeve 32 possibly retained with nuts 44,46,48 as would be understood by those of ordinary skill in the art. This way an operator with at least one, if not two wrenches could simply disconnect the connectors 38,40,42 from the at least the extension 36 and another sleeve 34 so another attachment could then be connected to the extensions 36 on frame arms 28,30.

Prior to doing this, it may be desirable to disconnect the first electrical connection 50 and/or second electrical connection 52 and/or first hydraulic connection 54 and/or second hydraulic connection 56 and/or others as may be present for various constructions. The hydraulic connections could be directed to such components as first cylinders and second cylinders 58,60 etc. and/or others as would be understood by those of ordinary skill in the art. Electrical connections such as first and second electrical connections 50,52 may provide power for the grasper 5 of the can dumper and dumping device shown in FIG. 2 and/or other devices. Connections 50-56 may be quick connect connections and not all attachments necessarily need to be provided with connections 50-56. These connectors 50-56 could be relatively rapidly connected and disconnected by an operator so that with them disconnected the mechanical connections of holding the sleeve 32 relative to the extension 36 could then be disconnected/connected as would be understood by those of ordinary skill in the art to relatively rapidly connect and/or disconnect a particular attachment such as the snow plow attachment 20 to frame arms 28,30 of a typical front loading garbage truck body 1.

While the connection 65,67 for the illustrated embodiment occurs above the upper connections 61,63 for the cylinders 58,60, in other embodiments it may occur below this connection 65,67 and/or other locations. In a preferred embodiment the entire frame arms 12,13 are not replaced, however, in other embodiments it may be possible to replace the entire frame arms 12,13 in a relatively efficient manner for this new type of versatility for a garbage truck body 1.

Figure 1B:
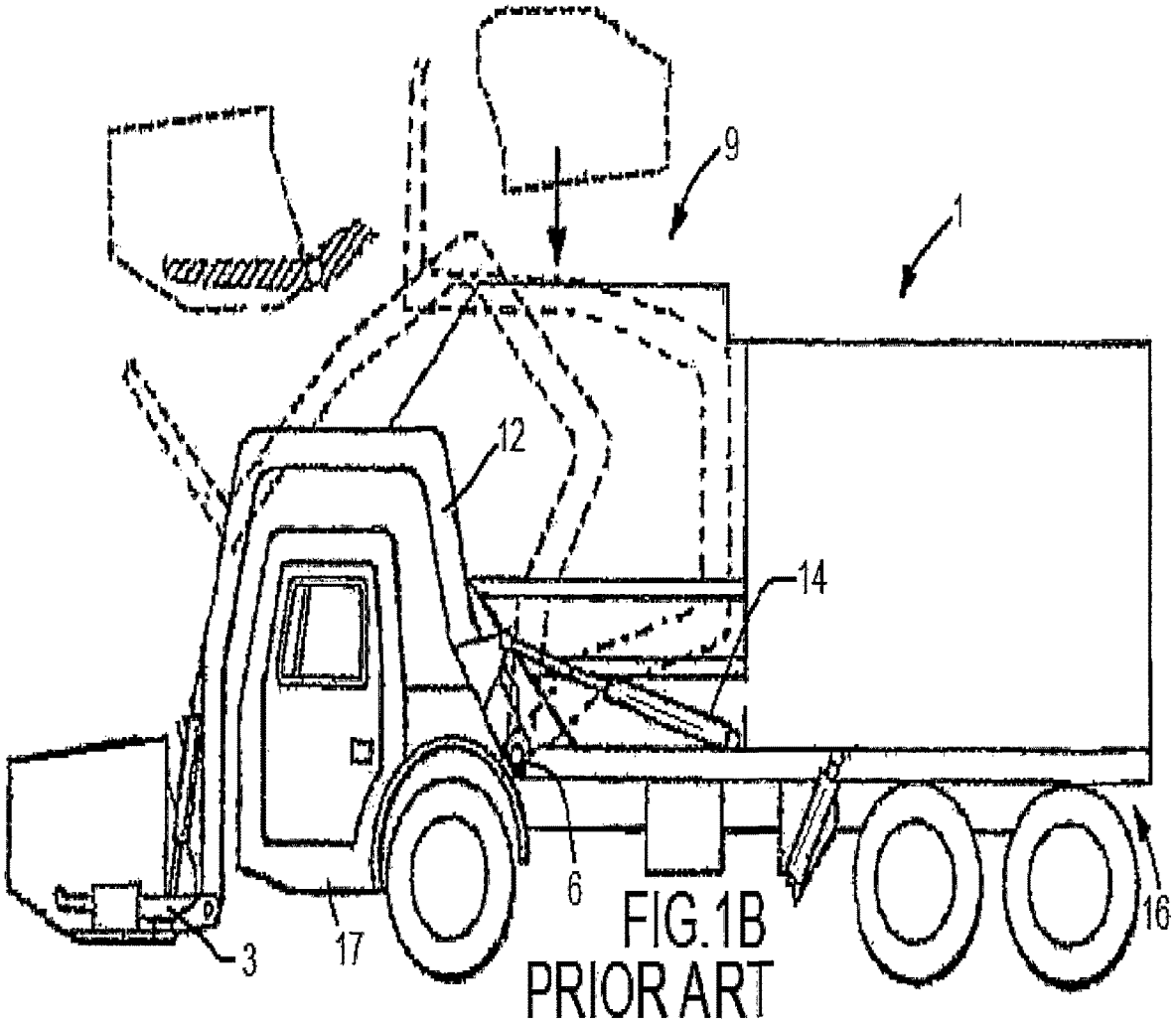
FIG.1B PRIOR ART
FIG. 1B is a side view of the prior art refuse body connected to a chassis.
Figure 10:
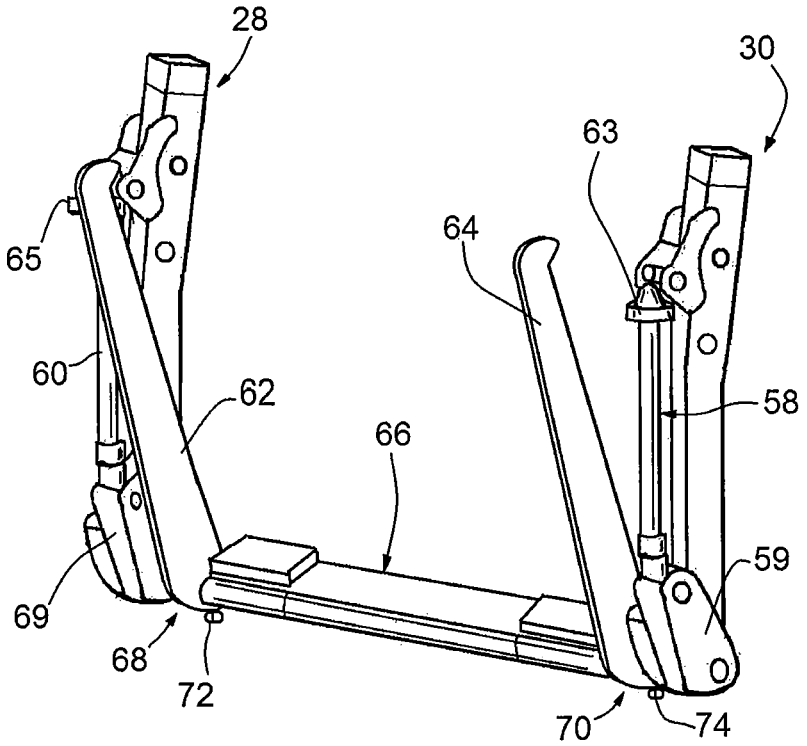
FIG. 10 is a front perspective view of a preferred embodiment with removable forks connected to a crossbar.
Figure 11:
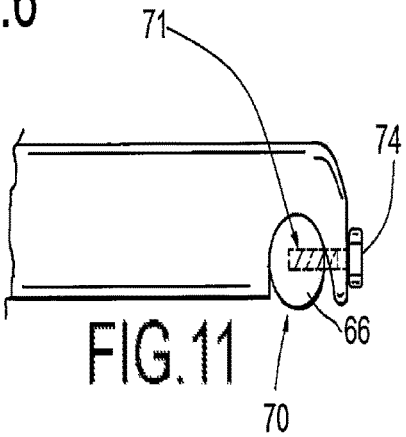
FIG. 11 is a cross sectional view of the cross bar and fork connection of FIG. 10.

Another option for at least some embodiments may be to use the standard frame arms 12,13 such as shown in FIG. 1 and have the forks 62,64 as shown in FIGS. 10 and 11 be constructed to be removably connected to cross bar 66 in one of the various ways as would be understood by those of ordinary skill in the art such as providing first and second grooves 68,70 which can fit over the cross bar 66 and possibly utilize connectors such as bolts and/or pins 72,74 to then anchor the forks 62,64 without a need to replace the cross bar 66. Pins 72,74 may extend into the cross bar 66 and be screwed such as in threaded bore 71 or otherwise secured thereto. With this construction, the cross bar 66 may be maintained in place for at least some embodiments. Yet, other embodiments of cross bar 66 could be removed which may facilitate a need to provide a different construction. With the cross bar 66 in place, there may be no need to change the hydraulic controls as the first and second pistons 58,60 will most likely remain in position so that the cross bar 66 can be rotated as would be understood by those of ordinary skill in the art. However, by having removable forks, 62,64 which are not typically removable from a cross bar 66 in the past, the ability then to connect such as at those locations or others with similar or different connectors 76 (the other being opposite and being obscured by snow plow attachment 20) could then be utilized to connect the snow plow attachment 20 to the cross bar 66 without a need to replace, connect and/or reconnect electrical and/or hydraulic connections in a similar or dissimilar manners as the forks 62,64. This style construction could be utilized with the frame arms 28,30 and arm connectors shown as extensions 34,36 as well for at least some embodiments.

Figure 5:
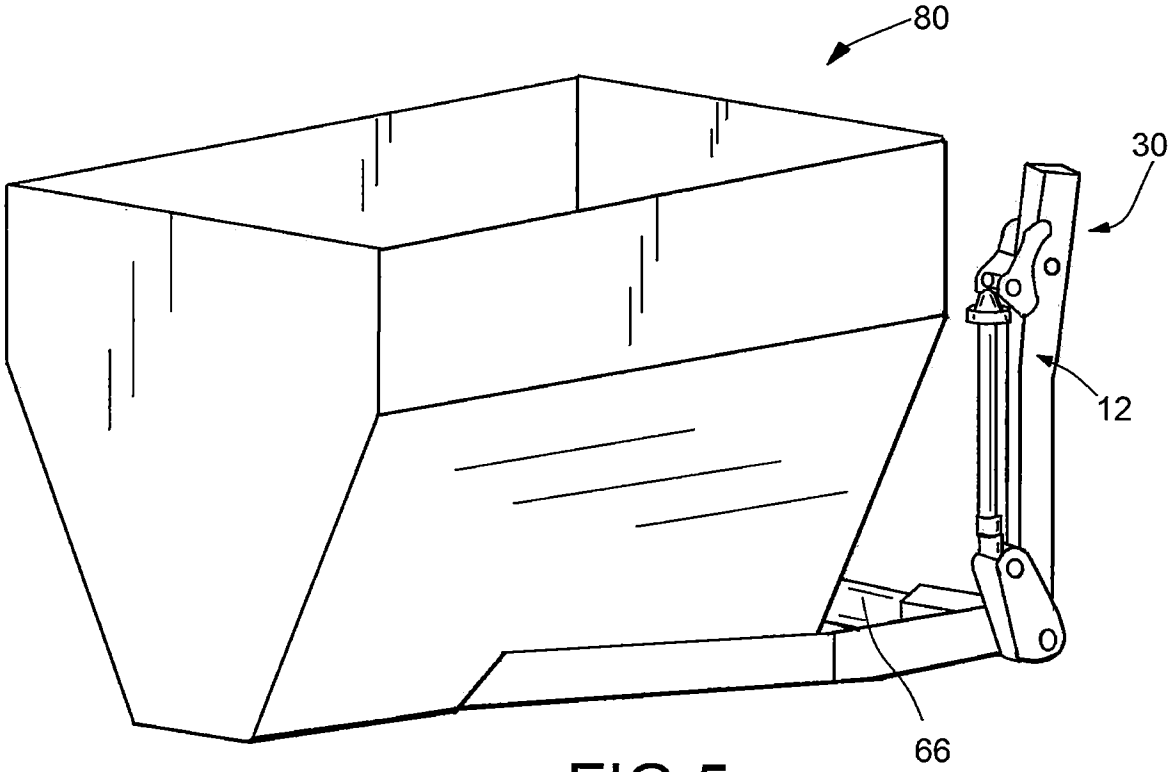
FIG. 5 is a front perspective view of the second attachment connected to the frame arms.

Accordingly, as can be seen by comparison of FIG. 10 with FIG. 3, the ability to swap out the forks 62,64 with the snow plow attachment 20 is believed to be novel over prior art construction for use with a garbage truck body 1 as can be provided on a vehicle 100 as is shown in FIG. 7 and others. While the snow plow attachment 20 may be useful in some applications, other attachments such as a salt spreader attachment 80 shown in FIG. 5 may be desirable which could connect with electrical and/or hydraulic connections such as connections 50-56 provided on the arms 12,13 (28,30) and/or on the cross bar 66 may be useful to operate portions of the salt spreader such as to be able to selectively dispense salt or other particulate from the spreader 80. Furthermore, it may be that the connections that are made or other device may receive an electric signal from the particular attachment such as attachment 20,80 so as to potentially limit and/or facilitate movement of the frame arms 28,30 and/or cross bar 66 for instance to prevent rotating the salt spreader 80 to contact the front of the chassis or other portion of the vehicle. RFID technology or other wireless technology could be utilized to assist in recognizing which attachment such as forks 62,64, snow plow attachment 20, salt spreader 80 and/or other attachments are connected at any point in time to assist in providing additional safety measures for an operator such as to automatically limit the motion of different attachments which are likely and/or preferably different than for the forks 62,64. A processor 202 and/or a controller 201 can be used to switch configurations for various embodiments either automatically and/or manually by an operator.

Figure 6:
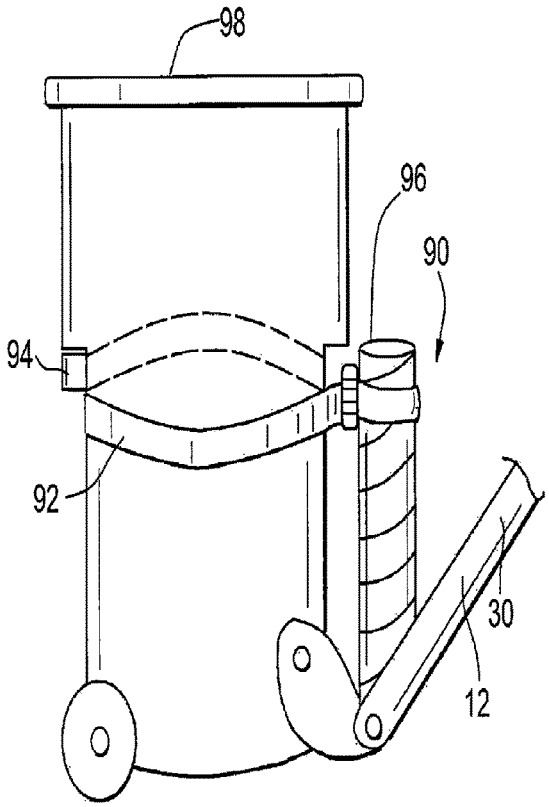
FIG. 6 is a side plan view of a third attachment attached to one of the frame arms.

FIG. 6 shows the left frame arm 30 connected to a residential can grasper attachment 90 which could be similar or dissimilar to other residential can grasping arms as typically have a first arm 92 which moves relative to a second arm 94 such as about a pivot 96 to grab a residential trash can 98 which could be a 95 gallon or other sized can. In this method, a single arm 12 could then be utilized to dump a single can which is shown with reference to FIG. 7 in the receiver 9. The operation of the left arm 12 is shown independent of the operation of the right arm 13 in this operational configuration which is different from the typical garbage collection configuration (both arms 28,30 move together). This way, while one arm is collecting residential cans, the other arm could support a container 102 such that the operators around the truck could be filling for the subsequent dumping of the receptacle 9 which may even be divided for some embodiments such as the ability to collect brush in the container 102 while dumping trash from the containers 98 on the other half. Other dual purpose arrangements could include collection of recyclables and general trash or different kinds of recyclables or other rationales to support a reason to split collection efforts. Furthermore, it may just be that additional trash above and beyond what has been in the cans 98 may be collected by the operators in the container 102. Of course, it may also be possible to split the operations other than just for receiving trash, it could be that two graspers are provided at the front with the ability to grasp two different residential cans and/or provide other features. Switching back to a garbage collection configuration to simultaneously raise and lower arms 28,30 could then be completed when switching to forks 62,64 or other attachment which prefers simultaneous movement. Other attachments may have other limitations associated therewith which differ from limitations associated with the garbage collection configuration.

Figure 9:
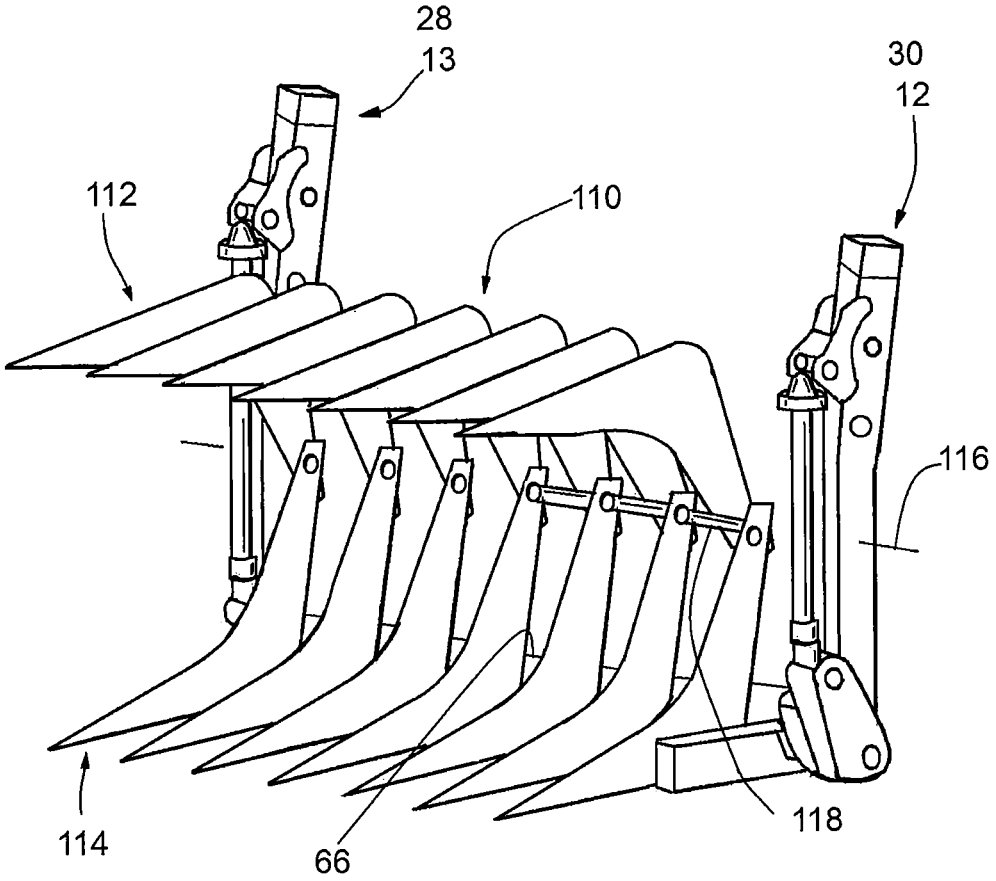
FIG. 9 is a fifth alternative attachment connected to the frame arms of the preferred embodiment.

FIG. 9 shows a grapple attachment 110 or at least a portion thereof having an upper row of fingers 112 which cooperate with a lower row 114 and while the lower row 114 can be driven by cross bar 66 the same rotation may depending on the location of pivot axis 116 such as could be connected by a shaft 118 or not could be made to be able to operate the clasping nature of the fingers 112,114. Other methodology could be employed relative to the rotation and/or movement of the cross bar 66 relative to pivot 118 as would be understood by those of ordinary skill in the art. Logs or other material could be picked up and/or other material picked up with the grapple attachment 110. Once again, the connections could be done as described above to swap out the attachment 110 with any of the other attachments and/or forks.

Figure 8:
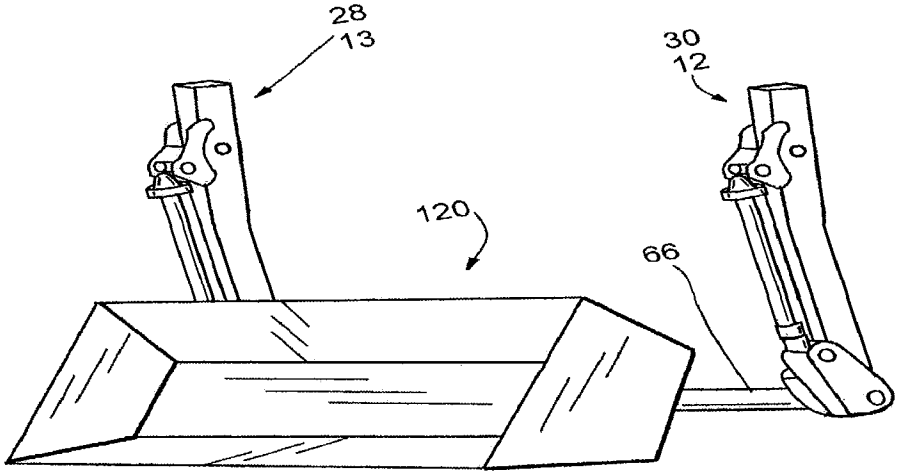
FIG. 8 is a fourth alternative attachment.

In addition to a dedicated residential automated collection container such as is shown in FIG. 2, a commercial fork system such as is shown in FIG. 10, other connections such as a snow plow shown in FIG. 3, a rear end loader container collection system could be employed, fork lift arms (not shown), a curb sweeping attachment (not shown), a curb leaf blowing attachment (not shown), a grapple attachment shown in FIG. 9, a bucket attachment as shown in FIG. 8, 120 and/or other could be provided as would be understood by those of ordinary skill in the art. The bucket attachment 120 of FIG. 8 could be connected by either utilizing the system shown in FIGS. 3 and 4, the system shown in FIG. 11 or other connection systems.

Now instead of going through and replacing the entire set of arms 12,13, at least for many embodiments of the arm connectors as described above could be exchanged quickly replace attachments. Alternatively, the specific attachments could be relatively easily replaced relative to a non-replaced cross bar 66 for at least some embodiments. Change out time is reduced and the possibility of multiple use could be a significant advantage. Arms 12,13 could be replaced as well for some embodiments.

RFID or other technology could be utilized to coordinate with software (such as pressure 202) to facilitate movement of the arms 28,30, crossbar 66 and or other portions of the system to ensure that the cab 122 or other portion of the refuse container body or carrier vehicle 100 is not inadvertently contacted with a particular piece of equipment from the attachments. A controller 201 could also be used for manual control by an operator. The technology could utilize the electrical and/or other communication system to coordinate the information as to which attachment is provided at any particular point in time. The technology may further advise the software and/or processor 201 that the attachment is securely connected and possibly provide other information.

Some competitors or others may try to replace the entire arms 12,13 as they connect all the way back to the pivot point at the refuse garbage truck body 1 for some embodiments. While this is certainly possible using the technology described herein, it is more likely than not that portions of the arms 12,13 (with arm connector) and/or connection portions of the attachments to the cross member 66 will be the more likely change out positions for various attachments as shown and described above through the systems taught and suggested herein.

While the application of this technology certainly will not apply to every front end loading garbage truck body 1 in the marketplace, there appears to be a likelihood that for those customers requiring versatility and the ability to multi task with a specific vehicle 100, this may be an excellent option for an ability to provide such services on a limited basis such as snow plow services particularly in the south where that would be a relatively rare occurrence without having a need to provide a separate vehicle with a snow plow. The same is true for a salt spreader attachment 80 particularly in some locations where there would be little expectations that garbage service would be provided such as a weather event.

For support of claims, a front loading refuse collection vehicle can have a chassis 16 supporting a refuse collection body 1. The chassis 16 can have a cab 17 disposed towards a front of the chassis 16 where an operator can drive the chassis 16. The refuse collection body 1 can have left and right frame arms 28,30 disposed towards a front bottom portion of the hopper 9 and rearward of the cab 17. The frame arms 28,30 can be pivotably connected relative to one of a hopper 9 and the chassis 16 on opposing sides of the hopper 9 along a pivot axis 6 and/or 7. Cylinders 14,15 can be connected to the frame arms 28,30 above the pivot axis 6 and/or 7, and to one of the chassis 16 and hopper 9 whereby said cylinders 14,15 direct the frame arms 28,30 in a radial manner about the pivot axis 6 and/or 7 whereby articles (or attachments) connected to the frame arms 28,30 may be directed to clear the cab 17 of the chassis 16 from in front of the cab 17 to up and over the cab 17 above the hopper 9. The refuse collection body 1 may have a first mode of operation whereby the left frame arm 30 can be independently rotated relative to the right frame arm 28 about the pivot axis or axes 6 and/or 7.

In the first mode of operation, a first of the left and right frame arms 28,30 may rotate to a dump state rear of the cab 17 in the hopper 9, while a second of the left and right frame arms 28,30 may have a forward-most portion forward of the cab 17 and below at least a portion of the operator in the cab 17 driving the vehicle for at least some embodiments.

The first of the left and right frame arms 28,30 may have a grabbing assembly 97 configured to grasp residential garbage cans 98.

A second of the left and right frame arms 28,30 can be connected to one of a leaf blower, a street sweeper, a snow plow, a bucket, and a refuse container.

At least one of the left and right frame arms 28,30 and a connecting cross bar 66 can connect the right and left frame arms 28,30 at ends of the frame arms opposite the frame arms from the pivot axis 6,7 and can be configured to receive at least one of plurality of attachments other than container forks 62,64.

A refuse collection body 1 can have a second mode of operation whereby the left and right frame arms 28,30 operate in synchronous movement together about the pivot axis 6 and/or 7.

A front loading refuse collection vehicle can have a chassis 16 supporting a refuse collection body 1, said chassis 16 having a cab 17 disposed towards a front of the chassis 16 where an operator can drive the chassis 16. Left and right frame arms 28,30 can be pivotably connected relative to a hopper 9 on opposing sides of the hopper 9 along a pivot axis 6 and/or 7. The pivot axis 6 and/or 7 can be disposed towards a front and bottom of the hopper 9 and rearward of the cab 17. Cylinders 14 and 15 can be connected to the frame arms 28,30 above the pivot axis 6 and/or 7 and to one of the chassis 16 and refuse collection body 1. The cylinders, through extension and retraction of pistons 91,92 may direct the frame arms 28,30 in a radial manner about the pivot axis 6 and/or 7 whereby attachments connected to the frame arms 28,30 are directed to clear the cab 17 of the chassis 16 from in front of the cab 17 to up and over the cab 17 and above the hopper 9.

A front cross bar 66 can connect the frame arms 28,30 at an end of the frame arms 28,30 opposite the pivot axis 6 and/or 7. Said front cross bar 66 can be rotatably driven relative to the frame arms by driver arms 59,69 connected by cylinders 58,60 to the frame arms, whereupon extension and retractions of pistons 63,65, the driver arms 59,69 can be moved rotationally while rotating the crossbar 66. The crossbar 66 can be configured to selectively connect to a selected one of a plurality of attachments in addition to container forks 62,64 used in a garbage dumping configuration. A container 4 can be at least temporarily supported by the container forks 62,64 and then rotated over the cab 17 and dumped in the hopper 9 in the garbage dumping configuration. The plurality of attachments can be selected from the group of a snow plow attachment, a blower attachment, a street sweeper attachment, a vacuum attachment, a bucket attachment, a grapple attachment, a grasper arm, and a spreader attachment or other attachments. The selected one of the attachments can connect directly to the crossbar 66 in a first alternative configuration.

A selected one of the plurality of attachments can coordinate with the frame arms 28,30 whereby when in the first alternative configuration, movement limitations which differ from movement limitations imposed in the garbage dumping configuration are provided to limit at least one of the rotational movement of the frame arms 28,30, the cross bar 66, and the cross bar 66 relative to the position of the frame arms 28,30. A selected one of the attachments provides a signal through one of a wireless (such as from device 199) and an electrical connection 50-56 to a processor 202 connected to one of the chassis 16 and the refuse collection body 1, said processor 202 receiving the signal and switching from the garbage dumping configuration to the first alternative configuration.

At least one quick connect 50-56 for a selected one of an electric and a hydraulic line 51,53 directed along the frame arms 28,30 towards the crossbar 66; and said selected one of the plurality of attachments connects to the quick connect 50-56 and provides one of electricity and hydraulics to the selected one of the plurality of attachments for operating at least a portion of the attachment. A front loading second of an electric and a hydraulic line 51,53 directed along the frame arms 28,30 provides the other of electricity and hydraulics to the selected one of the plurality of attachments for operating at least a portion of the attachment. The cab 17 can have a controller 201 there inside, said controller 201 switching from the garbage dumping configuration to the first alternative configuration upon receipt of input by an operator. The refuse collection body 1 can have a first mode of operation whereby the left frame arm 30 is independently rotatable about the pivot axis relative to the rotation of the right frame arm 28 about the pivot axis 6 and/or 7. The refuse collection vehicle can also provide a chassis 16 supporting a refuse collection body 1, said chassis having a cab 17 disposed towards a front of the chassis 16 where an operator can drive the chassis 16. The said refuse collection body 1 can have left and right frame arms 28,30 pivotably connected relative to a hopper 9 on opposing sides of the hopper 9 along a pivot axis 6 and/or 7. The pivot axis 6 and/or 7 can be disposed towards a front and bottom of the hopper 9 and rearward of the cab 17. Cylinders can be connected to the frame arms 28,30 above the pivot axis 6 and/or 7 and to one of the chassis 16 and refuse collection body 1, whereby said cylinders 14,15 through extension and retraction of pistons 91,93 direct the frame arms 28,30 in a radial manner about the pivot axis 6 and/or 7 whereby attachments connected to the frame arms 28,30 can be directed to clear the cab 17 of the chassis 16 from in front of the cab 17 to up and over the cab 17 and above the hopper 9.

There can be a garbage collection configuration and a first alternative configuration. When in the garbage collection configuration, a first arm connector assembly can be selectively connected to each of the frame arms 28,30, said first arm connector assembly having arm connectors such as sleeve 36 respectively selectively connected to and extending from the frame arms 28,30 to a front cross bar 66 connecting the frame arms 28,30 at an end of the frame arms 28,30 opposite the pivot axis 6 and/or 7, said front cross bar rotatably driven relative to the frame arms 28,30 by driver arms 59,69 connected by cylinders 58,60 to the frame arms 28,30. Upon extension and retractions of pistons 63,65, the driver arms 59,69 can be moved rotationally while rotating the crossbar 66; whereby when in the garbage collection configuration, a container 4 can be at least temporarily supported by the container forks 62,64 and can then be rotated over the cab 17 and dumped in the hopper 9.

When in said first alternative configuration, at least one of said frame arms 28,30 can be selectively connectable to a selected one of a plurality of attachments having arm connector assemblies such as sleeve 36 which can connect to at least one of the frame arms 28,30, said plurality of attachments being in addition to container forks 62,64 used in the garbage collection configuration and selected from the group of a snow plow attachment, a blower attachment, a street sweeper attachment, a vacuum attachment, a bucket attachment, a grapple attachment, a grasper arm, and a spreader attachment; and the selected one of the attachments connects as a second arm connector assembly with at least one arm extender connected to at least one of the first and second frame arms 28,30 in the first alternative configuration.

The front loading refuse collection vehicle of claim 14 wherein the selected one of the plurality of attachments coordinates with one of the chassis and the refuse collection body whereby when in the first alternative configuration, movement limitations of the frame arms 28,30 differ from movement limitations imposed when in the garbage dumping configuration to limit at least one of the movement of the frame arms 28,30, and the selected one of the plurality of attachments.

A one of the attachments can provide a signal through one of a wireless (such as from device 199, like an RFID device) and an electrical connection (50 or 52) to a processor 202 connected to one of the chassis 16 and the refuse collection body 1, said processor 202 receiving the signal and switching from the garbage dumping configuration to the first alternative configuration. The cab 17 can alternatively or additionally have a controller 201 there inside for switching from the garbage dumping configuration to the first alternative configuration upon receipt of input by an operator.

A quick connect 50-56 for a selected one of an electric and a hydraulic line can be directed along at least one of the frame arms 28,30 and the arm extensions such as a sleeve 36 or other structure. One of the plurality of attachments can use the quick connect 50-56 and provide at least one of electricity and hydraulics to the selected one of the plurality of attachments for operating at least a portion of the selected attachment.

Both the left and right frame arms 28,30 can be selectively connectable to the selected one of a plurality of attachments at opposing arm connector assemblies such as through sleeves 36 or otherwise which respectively connect the left and right frame arms 28,30 with the selected one of the plurality of attachments supported by both the left and right frame arms 28,30.

The refuse collection body 1 can have a first mode of operation whereby the left frame arm 30 is independently rotatable about the pivot axis 6 and/or 7 relative to the rotation of the right frame arm 28 about the pivot axis 6 and/or 7.

Furthermore, the ability to connect such attachments as street sweepers, leaf blowers and other devices may be done in conjunction with and/or container for it may be done in conjunction with the ability to provide a grapple attachment for a residential can so that not only could residential cans be picked up during a pass but simultaneously the truck could be providing leaf blowing or street sweeping in a relatively simultaneous manner to therefore potentially reduce the amount of fuel consumed by not requiring two trucks to make an extremely similar route or portions thereof. Still further advantages may be seen through experience and trying out various embodiments.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A front-loading refuse collection vehicle, comprising:
- a chassis;
- a cab coupled to a front portion of the chassis;
- a hopper coupled to the chassis rearward of the cab;
- left and right frame arms pivotably coupled to opposing sides of the hopper along a pivot axis,
- a crossbar extending between the left and right frame arms, the crossbar configured to alternatively and releasably couple with: (i) the left and right refuse-collection forks, and (ii) a road maintenance apparatus; and
- a control system configured to:
  - regulate movement of the frame arms; and
  - transition between a refuse collection mode and a non-refuse collection mode,
    - wherein, in the refuse collection mode with the refuse-collection forks coupled to the frame arms and the crossbar, the control system is configured to implement a first movement limitation with respect to the frame arms; and
    - wherein, in the non-refuse collection mode with the road maintenance apparatus coupled to the frame arms and the crossbar, the control system is configured to implement a second movement limitation with respect to the frame arms, the second movement limitation being different from the first movement limitation.

2. The front-loading refuse collection vehicle of claim 1, wherein the frame arms are releasably attached to opposing sides of the hopper.

3. The front-loading refuse collection vehicle of claim 1, wherein the control system, in at least the non-refuse collection mode, is configured to operate the frame arms to rotate independently about the pivot axis.

4. The front-loading refuse collection vehicle of claim 1, wherein the control system, in at least the refuse collection mode, is configured to operate the frame arms to rotate synchronously about the pivot axis.

5. The front-loading refuse collection vehicle of claim 1, wherein the pivot axis is disposed towards a front and bottom portion of the hopper and rearward of the cab.

6. The front-loading refuse collection vehicle of claim 1, further comprising a front cross bar coupling the left and right frame arms at distal end portions of the frame arms.

7. The front-loading refuse collection vehicle of claim 6, further comprising left and right driver arms coupled to (i) the frame arms; and (ii) the cross bar, the driver arms configured to drive rotation of the cross bar relative to the frame arms.

8. The front-loading refuse collection vehicle of claim 7, wherein the driver arms are configured to move rotationally while rotating the front cross bar.

9. The front-loading refuse collection vehicle of claim 6, wherein the front cross bar comprises first and second grooves configured to receive a portion of the refuse-collection forks.

10. The front-loading refuse collection vehicle of claim 1, wherein the road maintenance apparatus comprises at least one of: a snow plow attachment, a blower attachment, a sweeper attachment, a bucket attachment, a vacuum attachment, a grapple attachment, a grasper arm, a salt spreader attachment, or a grabbing assembly.

11. The front-loading refuse collection vehicle of claim 1, wherein the control system is configured to receive a signal output by the road maintenance apparatus.

12. The front-loading refuse collection vehicle of claim 11, wherein, in response to receiving the signal, the control system is configured to transition from the refuse collection mode to the non-refuse collection mode.

13. The front-loading refuse collection vehicle of claim 1, further comprising one or more hydraulic cylinders coupled to (i) the frame arms above the pivot axis; and (ii) the chassis.

14. The front-loading refuse collection vehicle of claim 13, wherein each of the one or more hydraulic cylinders comprise extension and retraction of pistons, and wherein actuation of the pistons drives rotation of the frame arms about the pivot axis.

15. The front-loading refuse collection vehicle of claim 1, wherein, in response to input from an operator, the control system is configured to transition from the refuse collection mode to the non-refuse collection mode.

16. The front-loading refuse collection vehicle of claim 1, further comprising an arm extension configured to couple at least one of the frame arms to the road maintenance apparatus.

17. The front-loading refuse collection vehicle of claim 16, wherein the road maintenance apparatus comprises a sleeve configured to receive a portion of the arm extension.

18. The front-loading refuse collection vehicle of claim 1, further comprising one or more quick-connect couplings configured to connect the road maintenance apparatus to at least one of an electrical or hydraulic connection of the front-loading refuse collection vehicle.

19. The front-loading refuse collection vehicle of claim 1, wherein the crossbar has first and second grooves receiving first and second refuse-collection forks.

20. The front-loading refuse collection vehicle of claim 19, further comprising two or more connectors extending through bores extending through the crossbar, the two or more connectors reversibly anchoring the first and second refuse-collection forks to the crossbar.

21. The front-loading refuse collection vehicle of claim 20, wherein the bores extending through the crossbar are aligned with the first and second grooves.

* * * * *